US005232305A

United States Patent [19]

Bassett et al.

[11] Patent Number: 5,232,305

[45] Date of Patent: Aug. 3, 1993

[54] PAVING MATERIAL DISTRIBUTION SYSTEM

[75] Inventors: James H. Bassett, Sycamore; James J. Plociennik, North Aurora; Jay A. King, Maple Park; James M. Reiseck, Aurora, all of Ill.; Harold A. Shelley, Nicholasville, Ky.

[73] Assignee: Caterpillar Paving Products Inc., Minneapolis, Minn.

[21] Appl. No.: 700,678

[22] Filed: May 15, 1991

[51] Int. Cl.[5] ..... E01C 19/12; E01C 19/18

[52] U.S. Cl. ..... 404/101; 404/110

[58] Field of Search ..... 404/110, 101, 83; 239/146; 299/39

[56] References Cited

U.S. PATENT DOCUMENTS

| | | | |
|---|---|---|---|
| 3,901,616 | 8/1975 | Greening | 404/102 |
| 3,907,451 | 9/1975 | Fisher et al. | 404/101 |
| 3,997,277 | 12/1976 | Swisher, Jr. et al. | 404/84 |
| 4,304,504 | 12/1981 | Trujillo | 404/108 |
| 4,708,519 | 11/1987 | Davin et al. | 404/101 |
| 4,749,304 | 6/1988 | Craig | 404/101 |
| 4,801,218 | 1/1989 | Musil | 404/101 X |
| 4,859,113 | 8/1989 | Layton | 404/101 |
| 4,871,025 | 10/1989 | Mayfield et al. | 404/110 X |
| 4,934,864 | 6/1990 | Mauldin | 404/101 X |
| 5,002,426 | 3/1991 | Brown et al. | 404/101 X |
| 5,073,063 | 12/1991 | Brown | 404/101 X |

*Primary Examiner*—Carl D. Friedman
*Assistant Examiner*—Nancy P. Connolly
*Attorney, Agent, or Firm*—Robert A. McFall

[57] ABSTRACT

A paving material distribution system for uniformly distributing a layer of paving material includes a containment member that is slidably mounted on the rear frame of a paving machine. A first means for conveying paving material laterally with respect to the direction of travel of the paving machine is positioned at a preselected distance from the containment member. Power means are also included to controllably, simultaneously move the containment member and the first means in a substantially vertical direction.

3 Claims, 2 Drawing Sheets

PAVING MATERIAL DISTRIBUTION SYSTEM

DESCRIPTION

1. Technical Field

This invention relates generally t a roadway construction apparatus and more particularly to a material distribution system for a roadway paving machine.

2. Background Art

A well known problem encountered in asphalt paving is the segregation of aggregate in paving material during transfer and deposition onto a roadway. In particular, separation of the larger aggregate in an asphalt mix from smaller aggregate or "fines" commonly occurs during transfer of the mix from a receiving station, such as a hopper or pickup head on a forward portion of a paving machine, to a lateral spreader, such as an auger, at the rear of the machine. This separation at transfer points commonly occurs because of the tendency of the larger aggregate to roll down an incline formed by the angle of repose of the asphalt mix. The outer edges of a receiving station then receive more coarse aggregate than the inner portion of the receiving station.

This separation of larger and smaller aggregate in an asphalt mix is the primary cause of two well recognized problems found in asphalt pavements. Vertical segregation, i.e., the uneven distribution of aggregate between the surface and the base of a laid-down mat of asphalt paving material will result in undesirable mat surface properties. Vertical segregation can occur when coarse aggregate rolls forward, toward the front of the paving machine and ahead of the lateral spreader, or auger, and thus becomes the first deposited material on the surface to be paved. The paving material subsequently deposited on top of the course aggregate thus contains higher than desirable proportionate amounts of small aggregate and fines. Due to the consequent shortage of larger aggregate at the surface, tire loading during use of the roadway will cause the surface material to flow, especially in the most used tire pathways, resulting in a condition commonly known as rutting.

A second problem, transverse segregation, more commonly known as "center streak" occurs when a disproportionate amount of the large, or coarse, aggregate is deposited at the center of the mate being formed. This problem occurs when segregated coarse aggregate in the asphalt mix is fed, typically at the transverse center of the paving machine, to the auger distributor and rolls under a centrally disposed auger drive case. The coarse aggregate thus fills this region and inhibits the entrance of smaller aggregate and fines. This produces an area, or strip, of coarse aggregates with few fines to fill voids and bind the mix together. Without the necessary binding materials, the coarse aggregate breaks loose from the road surface, producing a condition commonly known as "ravelling".

Prior attempts to prevent the segregation of aggregate in an asphalt during deposition of the material on the roadway surface having only been partially successful. For example, some paving machines have a rear frame member than extends downwardly toward the roadway surface to partially deflect the mix and somewhat limit the forward rolling of the mix ahead of the auger. However, since asphalt pavers are commonly loaded on trailers for transport between job sites, the lower edge of the rear frame member must be sufficiently above the roadway surface to provide necessary clearance for ramp loading and unloading of the machine. Thus, due to these loading and transport requirements, the distance between the ground surface and the bottom edge of the rear frame member is such that the ability of the rear frame member to prevent forward rolling of the coarse aggregate, and the consequent vertical separation of aggregate in the paved mat, is severely compromised.

The present invention is directed to overcoming the problems set forth above. It is desirable to have an effective, economical paving material distribution system that deposits a uniform, unsegregated mixture of paving material on a base surface. It is also desirable to have such a distribution system that prevents separation of coarse aggregate from an asphalt mix during deposition and thus avoids the problems of rutting and ravelling. Further, it is desirable to have an effective paving material distribution system that may be raised to provide sufficient clearance so that a paving machine carrying the distribution system may be driven up a steep ramp, such as a trailer loading ramp.

DISCLOSURE OF THE INVENTION

In accordance with one aspect of the present invention, a paving material distribution system for uniformly distributing a layer of paving material along a pathway having a predetermined width, is carried on a paving machine having a rear frame member, and includes a paving material containment member having a length substantially equal to the width of the pathway being paved. The containment member has a bottom edge extending continuously along the entire length of the containment member and is slidably mounted on the rear frame member of the paving machine. The distribution system also includes first means for conveying paving material across the width of the layer of paving material. The first means has a total length substantially equal to the length of the containment member, and has a first side that is positioned at a preselected distance from the containment member. The distribution system further includes power means for controllably, simultaneously moving the containment member and the first means in a substantially vertical direction.

Other features of the paving material distribution system include a second means that cooperates with the containment member to define a chamber for receiving paving material and providing a reservoir for maintaining a preselected volume of paving material above the first means.

BEST MODE FOR CARRYING OUT THE INVENTION

Figure 1:
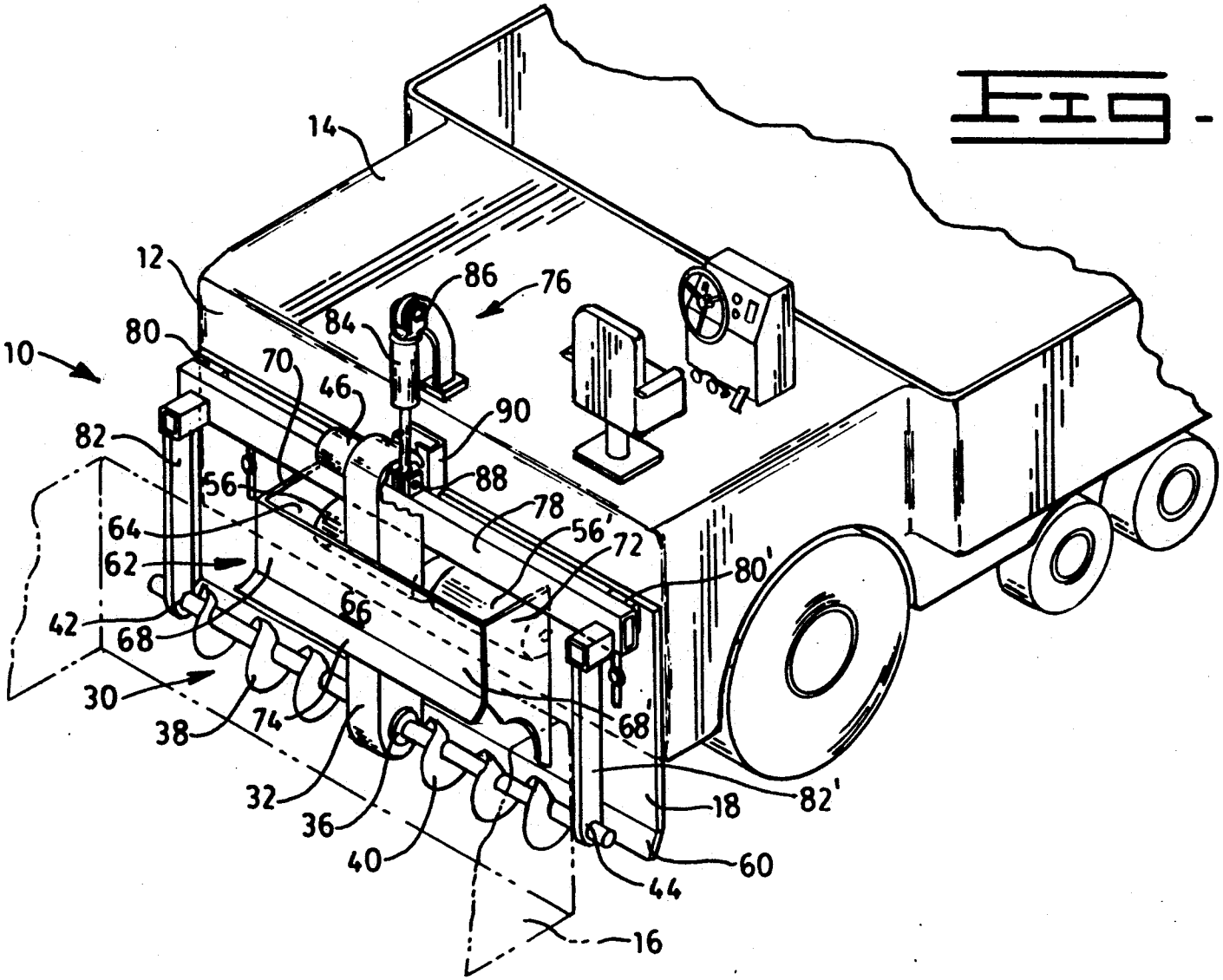
FIG. 1 is an isometric view of a paving machine having a paving material distribution system embodying the present invention.
Figure 3:
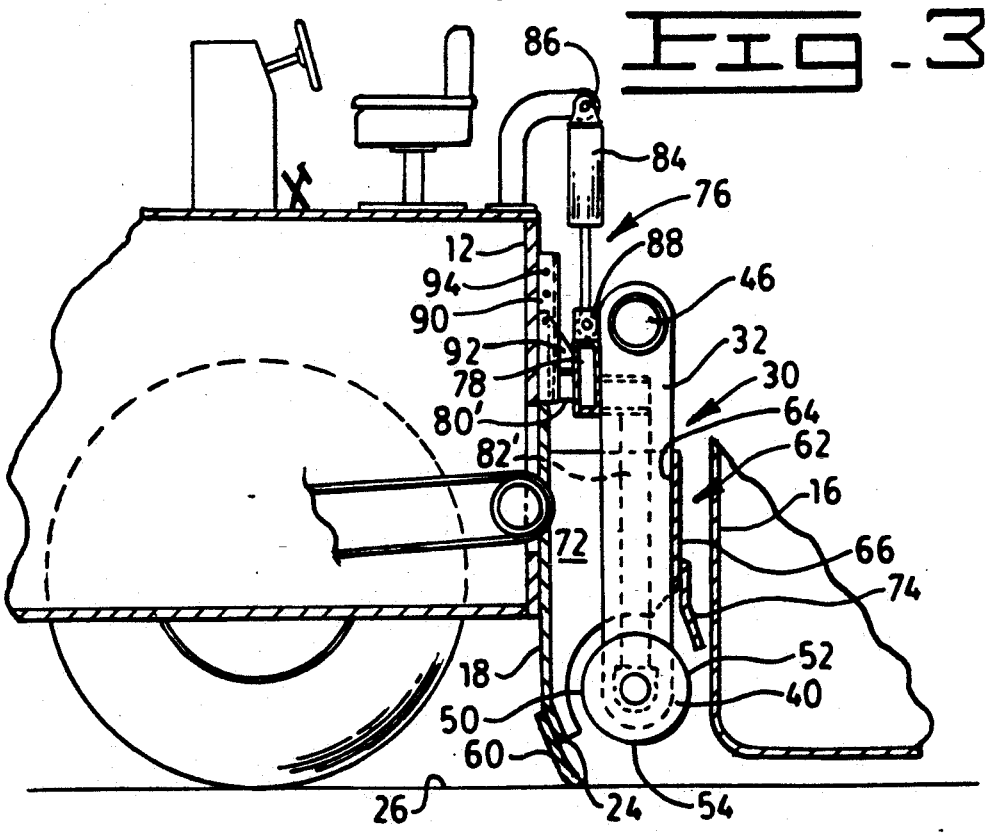
FIG. 3 is a cross-sectional view of the paving material distribution system embodying the present invention, taken along the line 3—3 of FIG. 2.

In the preferred embodiment of the present invention, a paving material distribution system 10 is mounted on a rear frame member 12 of a paving machine 14. In the interest of clarity, a screed assembly 16, normally towed behind the paving machine 14, is shown in phantom lines in FIG. 1. A partial section of the screed assembly 16 is shown in FIG. 3.

The paving material distribution system 10 includes a paving material containment member 18 that is slidably mounted on the rear frame member 12 of the paving machine 14. The containment member 18 is preferably a metal plate having a pair of vertically oriented slots 20,20' positioned near the outer ends of the containment member. The slots 20,20' cooperate with a pair of bolts 22,22' threaded into the rear frame member 12 to provide guide surfaces for alignment of the containment member 18. The bolts 22,22' may be tightened after the distribution system 10 is elevationally positioned on the rear frame member 12 to maintain a bottom edge 24 of the containment member 18 and, as described below, other attached elements of the distribution system at a desired fixed elevation above a surface 26 on which the paving machine 14 is supported. Preferably, the bottom edge 24 extends continuously along the entire length of the containment member 18.

The length of the paving material containment member 18 is substantially equal to the width of a layer of paving material distributed by the distribution system 10 along a pathway that is determined by the direction of travel of the paving machine 14. Depending on the arrangement and construction of the screed system 16, the width of the layer of paving material distributed by the distribution system 10 may extend either totally, or somewhat less than totally, between the actual outside edges of a mat shaped by the screed system. In arrangements where the distribution system does not extend completely to the actual outside edges of the mat, the screed system moves a sufficient amount of paving material laterally to fill the area between the outer end of the distribution system and the outside edge of the mat. Thus, as used herein in the specification and the claims, the term "a length substantially equal to the width of the layer of paving material" means a length that is sufficient to effectively distribute paving material uniformly across the width of the mat, and may be either the actual total distance between the outside mat edges or somewhat less than the actual total distance between outside mat edges.

Figure 2:
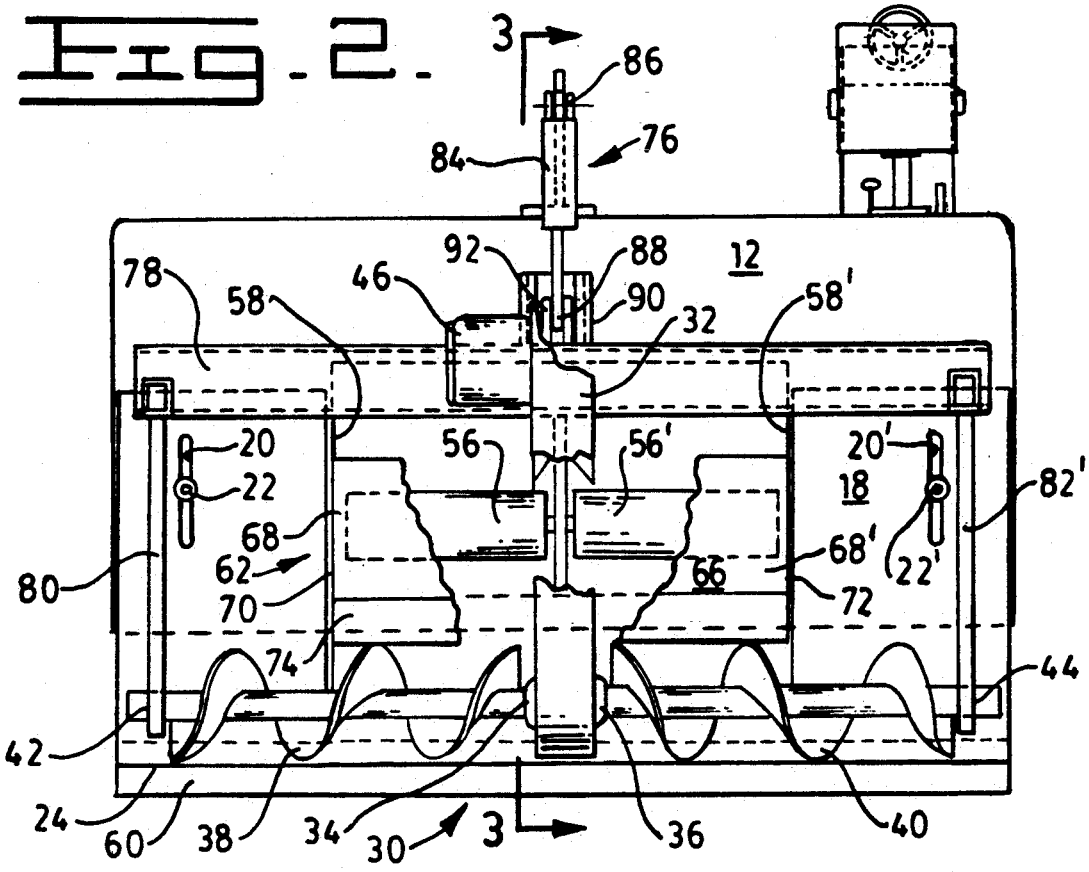
FIG. 2 is a partial elevational view of the paving material distribution system embodying the present invention.

The paving material distribution system 10 also includes a first means 30 for conveying paving material in preselected directions across the width of the layer of paving material and has a length that is substantially equal to the length of the containment member 18. Preferably, the first means 30 includes an auger drive assembly 32 having a pair of bearing supports 34,36 mounted in a lower portion of the drive assembly 32. The first means also includes separate left and right augers 38, 40 that are rotatably mounted at their inboard ends in a respective one of the bearing supports 34,36, and at their outboard ends by respective bearing supports 42,44. A pair of hydraulic motors 46 are mounted on an upper portion of the auger drive assembly 32 and are connected through drive chains to a respective one of the augers 38,40. In the interest of clarity, an upper portion of the auger drive assembly 32 is broken away in FIGS. 1 and 2 to show details that will be later described. Thus, although there is an hydraulic motor mounted on each side of the drive assembly 32, only the motor on the left side of the drive assembly is shown in the drawings. The rotational speed of the motors 46 is controlled to rotate the augers 38, 40 at the same speed or, if required, at different speeds to distribute a selected amount of paving material along the axis of the augers. Each of the augers 38,40 have a first side 50 facing the containment member 18, a second, or opposite, side 52 facing the screed system 16, and a bottom side 54 facing roadway surface 26.

Typically, a prepared mix of paving material is transferred from a surge bin or pickup head, not shown, at the front of the paving machine 14 to a lateral spreader at the rear of the machine. In the illustrative embodiment associated with the present invention, paving material is transferred, or fed, to the paving material distribution system 10 by one or more feeder conveyors 55,56' through openings 58,58' in the rear frame member 12 of the paving machine 14. It is recognized that whenever a material containing a mixture of differently sized particles is transferred in this manner, there is a tendency for the larger sized particles to separate, or become segregated, from the smaller sized particles. Furthermore, if the paving material fed by the feeder conveyors 56,56' to the augers 38,40 is permitted to roll ahead of the augers during lateral distribution of the material across the mat, additional segregation will occur, and the segregated larger aggregate roll forwardly and be the first material deposited on the roadway surface 16. The remaining pavement mixture containing a disproportionately large amount of small aggregate and fines will then be deposited on top of the first deposited larger aggregate. Thus, the finished pavement mat will have an uneven distribution of aggregate from its surface to its base. This vertical segregation of aggregate in the mat is a defect and, as described above, produces the undesirable condition commonly known as rutting.

Therefore, in carrying out the present invention, it is particularly important that the distance between the first side 50 of the first means 30, i.e., the side of the augers 38,40 facing the containment member 18, and the containment member 18 be controlled to assure that the paving material mixture will be prevented from rolling ahead of the augers. Preferably, this distance should be between about 1 to about 1.5 times the nominal diameter of the largest aggregate in the paving material being distributed by the first means 30.

In an illustrative embodiment of the present invention, the distance between the first side 50 of the first means 30 and the containment member 18 is about 2 inches (5 cm).

To further avoid the problem of vertical segregation of aggregate in the finished mat, it is important that paving material not roll ahead of the augers 38,40. To prevent the unconstrained forward rolling of the mix ahead of the augers it is desirable that the bottom edge 24 of the containment member 18 be substantially level with the bottom side 54 of the first means 30. That is, the bottom edge 24 of the containment member 18 should be maintained at substantially the same elevation as the side of the augers 38,40 facing the roadway surface 26.

Although it would be desirable to have the bottom edge 24 of the containment member 18 in virtual contact with the roadway surface 26, this is not practical in actual use due to the presence of raised obstacles in the path of the paving machine, such as manhole covers of raised sections. To overcome this problem, it is desirable that the paving material distribution system have a deflectable flap member 60 attached to the bottom edge 28 of the containment member 18 that extends substantially along the entire length of the containment member. Also, the deflectable flap member 60 should have a height sufficient to extend from the bottom edge 24 of the containment member 18 to the roadway surface 16. The flap member 60 may conveniently be constructed of a flexible rubber belting material, or be a rigid metal member that is mounted on the containment member with deflectable spring connectors.

The paving material distribution system 10 embodying the present invention also preferably includes a second means 62 that cooperates with the containment member 18 to define a chamber 64 for receiving paving material and providing a reservoir for maintaining a preselected volume of paving material above the first means 30. In the preferred embodiment of the present invention, the second means 62 includes a rear plate 66 having spaced apart end portions 68,68' The rear plate 66 is attached in a spaced relationship to the containment member 18 by a pair of side plates 70,72 which extend from the spaced apart end portions 68,68' of the rear plate 66 to the containment member 18. The containment member 18, rear plate 66, and the side plates 68,68' thus cooperate to form the chamber 64 which, in the preferred embodiment, is essentially a four sided hopper or chute having an open top adjacent the discharge opening 58,58', and an open bottom positioned directly above the first means 30. In operation the amount of paving material fed to the chamber 64 is determined by the speed of the feeder conveyors 56,56', which are controlled to assure that a head, or supply, of paving material is maintained in the chamber.

Importantly, the chamber 64 is positioned immediately above the first means 30. To prevent the free flow of paving material rearwardly of the augers 38,40 to a "dead zone" between the augers and the screed system 16, it is desirable that the rear plate 66 forming the chamber 64 be spaced from the containment member 18 a distance not greater than the distance that the second side 52 of the first means 30 is spaced from the containment member. That is, the rear plate 66 should not be positioned behind the side of the augers 38,40 facing the screed system 16. To further restrict the possible segregation of paving material by larger aggregate rolling from the chamber 64 to the "dead zone" between the augers and the screed system a flap member 74 constructed of a flexible rubber belting material may be advantageously attached to a lower edge of the rear plate 66.

The paving material distribution system 10 also includes power means 76 for controllably, simultaneously moving the containment member 18, the first means 30, and the second means 62 in a substantially vertical direction. In the preferred embodiment of the present invention, the power means 76 includes a support beam 78 that extends across the rear of the paving machine 14. The auger drive assembly 32 of the first means 30 is directly attached to the support beam 78, and the rear plate 66 of the second means 62 is fixedly attached to the auger drive assembly 32. Additionally, the containment member 18 is attached to the support beam by spacers 80, one of which is shown in FIG. 3. The spacers 80 are disposed between the support beam and the containment member near their respective outboard ends.

The support beam 78 also has a pair of auger support struts 82,82' extending downwardly from the outer ends of the support beam 18. The outboard bearing supports 42,44 are carried in respective lower portions of the struts 82,82' and rotatably support the augers 38,40 in fixed spaced relationship with respect to the support beam 78. Thus, the containment member 18, the first means 30, and the second means 62 are all operatively connected to the support beam 78 and consequently move simultaneously with each other and with the support beam.

Vertical movement of the support beam 78 is provided by a hydraulic cylinder 84 having a first end 86 attached through a pin connection to the rear frame member 12 and a second end 82 attached through a second pin connection to the support beam 78. The hydraulic cylinder 84 is provided, in the manner well known in the hydraulic actuator art, with a controllable source of pressurized hydraulic fluid to extend and retract the cylinder, thus raising and lowering the support beam 78 and the paving material distribution system 10 attached thereto.

Vertical movement of paving material distribution system 10 is guided by a guideway 90 attached to the rear frame member 12 of the paving machine 14. Typically, the guideway 90 comprises a T-slot arrangement in which a T-shaped guide member 92 extends outwardly from the support beam toward the rear frame member 12 and slidably engates mating slots in the guideway 90. Desirably, a plurality of openings 94 are be provided through the sides of the guideway 90 to permit insertion of a locking pin, not shown, through the guideway and through associated holes in the T-shaped guide member 92. In this manner, the paving material distribution system 10 may be locked at a fixed elevation if desired, such as when loading or transporting the paving machine 14.

Alternatively, the power means 76 may comprise a pair of hydraulic cylinders, each of which may be attached to a respective outboard end of the support beam 78. Also, if desired, two laterally spaced guideways and guide members may be provided to provide alignment of the distribution system 10 during vertical movement instead of the single guideway and guide member described above. Further, combinations of single or multiple hydraulic cylinders, and guideways and guide members, may be used in carrying out the present invention.

In operation, paving material is transferred from a forward bin or pickup head by the feeder conveyors 56,56' to the chamber 64 of the distribution system 10. As described above, the feeder conveyors deliver paving material to the chamber 64 and maintain a reservoir, or head, of the paving material in the chamber 64, positioned above the augers 38,40. The paving material flows from the chamber 64 by gravity feed onto the augers 38,40 and is carried laterally along the axis of the augers toward both the center and the outer edges of the mat being shaped by the rearwardly disposed screed system 16. Falling of segregated paving material directly onto the roadway surface 16 and rolling of segregated paving material ahead of the augers 38,40 is prevented by the horizontal and vertical position of the continuous containment member 18 in front of the augers. Importantly, the height of the bottom side of the augers 38,40 and the bottom edge 24 of the containment member 18 above the roadway surface 16, and accordingly the depth of paving material distributed in front of the trailing screed system 16, is adjustably controlled simultaneously by appropriate extension or retraction of the hydraulic cyliner 84.

INDUSTRIAL APPLICABILITY

In typical asphalt paving operations, the paving material distribution system 10 embodying the present invention advantageously distributes a uniform, nonsegregated mixture of paving material on a roadway surface 26 ahead of a towed screed system 16. Thus, vertical and transverse segregation of aggregate in the paved mat are averted, and the resultant problems of rutting and ravelling are avoided.

The present invention is also adaptable for use with relatively wide or variable width paving applications wherein extensions on the outboard ends of the containment member 18 and the augers 38,40 can effectively move the paving material transversely while simultaneously preventing the forward rolling of segregated paving material.

The paving material distribution system embodying the present invention is also capable of being raised as a unit, independently of the paving machine main frame and any associated screed systems, to permit the paving machine to be driven up steep ramps for loading.

Other aspects, objects and advantages of this invention can be obtained from a study of the drawing, the disclosure, and the appended claims.

We claim:

1. A paving material distribution system for uniformly distributing a layer of paving material along a pathway having a predetermined width, said paving material distribution system being carried on a paving machine having a rear frame member, said paving material containing aggregate having a predetermined maximum nominal diameter, said pathway being determined by a forward direction of travel of said paving machine, and said predetermined width of said layer of paving material being defined as the distance across said layer in a direction transverse to the forward direction of travel of said paving machine, comprising:

a paving material containment member having a length substantially equal to the width of said layer of paving material and a bottom edge extending continuously along the entire length of said containment member, said containment member being slidably mounted on the rear frame member of said paving machine;

a rotatable auger mounted on said paving machine and spaced from said containment member in a direction opposite to said forward direction of travel of said paving machine at a distance equal to from about 1 to about 1.5 times the maximum nominal diameter of the aggregate in said paving material;

a deflectable flap member attached to the bottom edge of said containment member and extending substantially along the entire length of said containment member; and power means for controllably, simultaneously moving the containment member and the rotatable auger in a substantially vertical direction.

2. A paving material distribution system for uniformly distributing a layer of paving material along a pathway having a predetermined width, said paving material distribution system being carried on a paving machine having a rear frame member, said paving material containing aggregate having a predetermined maximum nominal diameter, said pathway being determined by a forward direction of travel of said paving machine, and said predetermined width of said layer of paving material being defined as the distance across said layer in a direction transverse to the direction of travel of said paving machine, comprising:

a paving material containment member having a length substantially equal to the width of said layer of paving material and a bottom edge extending continuously along the entire length of said containment member, said containment member being slidably mounted on the rear frame member of said paving machine;

a rotatable auger mounted on said paving machine and spaced from said containment member in a direction opposite to said forward direction of travel of said paving machine at a distance equal to from about 1 to about 1.5 times the maximum nominal diameter of the aggregate in said paving material; and power means for controllably, simultaneously moving the containment member and the rotatable auger in a substantially vertical direction, said power means comprising a support beam operatively connected to said containment member and to said rotatable auger, and a hydraulic cylinder having first and second ends, said first end of said cylinder being attached to the rear frame member of said paving machine, and said second end of said cylinder being attached to said support beam.

3. A paving material distribution system for uniformly distributing a layer of paving material along a pathway having a predetermined width, said paving material distribution system being carried on a paving machine having a rear frame member, said paving material containing aggregate having a predetermined maximum nominal diameter, said pathway being determined by a forward direction of travel of said paving machine, and said predetermined width of said layer of paving material being defined as the distance across said layer in a direction transverse to the forward direction of travel of said paving machine, comprising:

a paving material containment member having a length substantially equal to the width of said layer of paving material and a bottom edge extending continuously along the entire length of said containment member, said containment member being slidably mounted on the rear frame member of said paving machine;

a rotatable auger mounted on said paving machine and spaced from said containment member in a direction opposite to said forward direction of travel of said paving machine at a distance equal to from about 1 to about 1.5 times the maximum nominal diameter of the aggregate in said paving material;

a rear plate disposed elevationally above said rotatable auger and spaced from said containment member in a direction opposite to said forward direction of travel of said paving machine and having spaced apart end portions;

a pair of spaced apart end plates each of width extend between a respective one of the end portions of said rear plate and said containment member; and power means for controllably and simultaneously moving said containment member, said rear plate, said pair of side plates, and said rotatable auger in a substantially vertical direction.

* * * * *